United States Patent [19]

Reeside

[11] Patent Number: 4,883,174

[45] Date of Patent: Nov. 28, 1989

[54] WRENCH SOCKET ASSEMBLY

[76] Inventor: Ralph F. Reeside, 4316 Leland St., Chevy Chase, Md. 20815

[21] Appl. No.: 270,811

[22] Filed: Nov. 14, 1988

[51] Int. Cl.[4] ..... B65D 85/20

[52] U.S. Cl. ..... 206/378; 206/478

[58] Field of Search ..... 206/378, 372, 392, 478, 206/477

[56] References Cited

U.S. PATENT DOCUMENTS

| | | | |
|---|---|---|---|
| 4,421,230 | 12/1983 | Stanton | 206/378 |
| 4,621,738 | 11/1986 | DeLucchi | 206/378 |
| 4,711,353 | 12/1987 | Rozmestor | 206/378 |

*Primary Examiner*—Joseph Man-Fu Moy

*Attorney, Agent, or Firm*—Wilmer Mechlin

[57] ABSTRACT

Wrench socket assembly for holding wrench sockets with their drive or wrench handle-engaging ends up, each socket being tightly held by and swivelable relative to an elastomeric ball received in and of somewhat greater cross-sectional area than its nut or work-engaging opening, the balls being molded on and, when worn, discardable with studs releasably mounted upright on a supporting surface of a holder and being arranged in the holder in seleted size sequence, and the size and shape of the work opening of each socket being anodized or otherwise imprinted on its drive end.

8 Claims, 1 Drawing Sheet

FIG. 1.
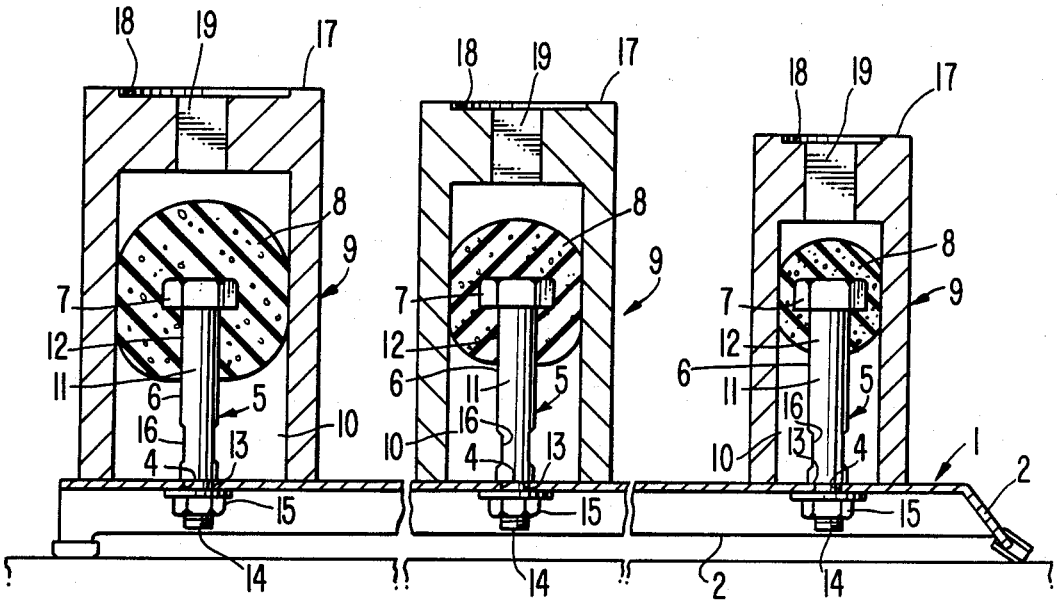
FIG. 2.
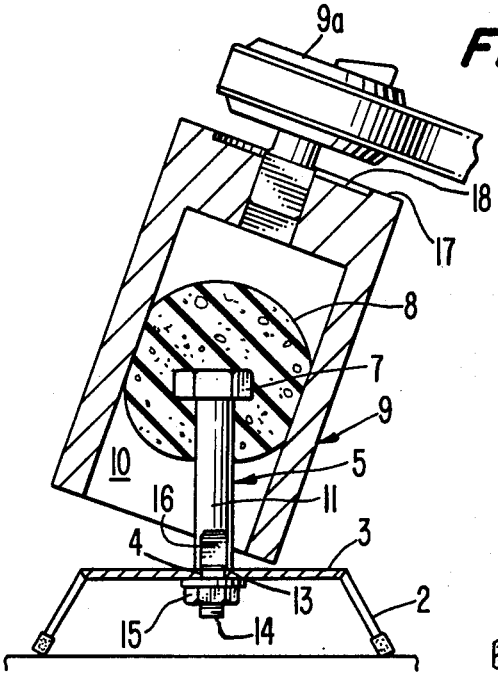
FIG. 4.
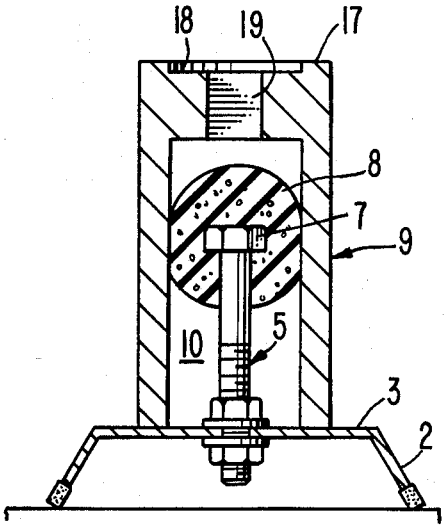
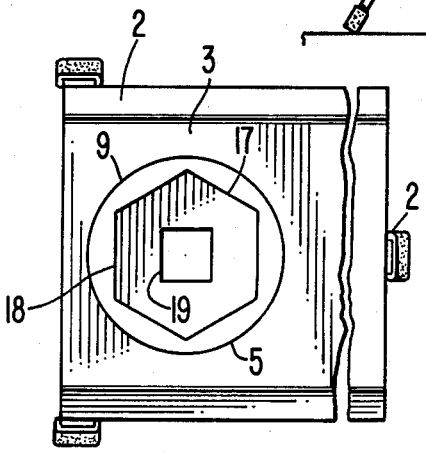
FIG. 3.

WRENCH SOCKET ASSEMBLY

BACKGROUND OF THE INVENTION

Socket wrenches with sets of interchangeable sockets are widely employed for mechanical tasks involving assembly and disassembly because of the convenience of using a single handle or, for work requiring different mechanical advantages, as few as three handles of different size, and suitable sets of sockets for actuating nuts and bolts of various sizes and shapes.

Wrench sockets are usually obtainable in sets of different size ranges but can be utilized efficiently by a worker only if from the available sockets, he can readily select and engage with a wrench handle the socket required for a particular task. Whether in a case also containing a handle and adapters or in a separate holder, the sockets of a set are customarily arranged in a selected order or sequence, usually based on size, and, when in a holder, are usually vertically disposed with their work-engaging ends up or exposed. Such a holder, typified by that disclosed in Pierce U.S. Pat. No. 3,405,377, has the advantage of exposing for selection the size and shape of its work-engaging opening but the disadvantage of requiring a socket to be detached from the holder before it can be engaged by a wrench handle. As opposed to Pierce, DeLucchi U.S. Pat. No. 4,621,738 discloses a socket holder in which the sockets are mounted on resilient studs of nut configuration with their drive or handle-engaging ends up or exposed for single-handed release by and engagement with a wrench handle. In the embodiment of FIGS. 4 and 5, each of DeLucchi's resilient studs is sandwiched or contained between a support plate and compression cap and has a lock bolt extending through a bore for enabling the stud on being turned in one direction to be compressed and radially expanded to secure the socket to the holder.

The concern of the present invention is an improved wrench socket assembly in which, as in DeLucchi, the sockets are held with their drive ends exposed for engagement by a wrench handle.

SUMMARY OF THE INVENTION

The primary object of the present invention is to provide an improved wrench socket assembly wherein the sockets are mounted with their drive ends exposed and each socket is releasably secured by and swivelable on a mounting stud having molded thereon an elastomeric ball received in and of greater cross-sectional area than the socket's work-engaging opening.

Another object of the invention is to provide a wrench socket assembly wherein the sockets are held with their drive ends exposed for selective single-handed engagement by a wrench handle, and each socket is releasably secured by and swivelable on an elastomeric spherical molded head of a stud having a relatively reduced threaded lower end portion extending through an opening in and threadedly secured to a supporting shelf of the holder.

An additional object of the invention is to provide a socket holder in which sockets are held with their handle-engaging ends exposed on elastomeric spherical heads of studs, each head of greater cross-sectional area than the socket it is designed to hold, and the studs are individually discardable and replaceable when rendered ineffective by wear of their spherical heads.

A further object of the invention is to provide a holder for wrench sockets in which a series of sockets are held in selected arrangement by studs comprised of bolts having molded about heads thereof elastomeric spherical heads each of a size to tightly fit and swivelly engage a work opening of and hold one of the sockets, the bolts being smooth-shanked and having relatively reduced threaded distal end portions interchangeably fitting in drillings of uniform diameter in a supporting shelf and threadable therebelow into nut means.

Another object of the invention is to provide a wrench socket assembly including a stand, a set of studs having elastomeric spherical heads interchangeably boltable in selected arrangement to a shelf of the stand, each for swivelly engaging a work-opening of and holding one of the sockets, and indicia of size and shape anodized or otherwise imprinted on drive ends of the sockets.

A further object of the invention is to provide a wrench socket assembly according to the immediately preceding object, wherein the stand is of bent or stamped sheet metal and three-legged having at one end and opposite sides a pair of laterally spaced rubber-footed legs and at the other end a laterally centered leg, and the shelf is horizontally disposed and supported on the legs.

The foregoing and other objects and advantages of the invention will appear hereafter in the detailed description, be particularly pointed out in the appended claims, and be illustrated in the accompanying drawings, in which:

FIGURE DESCRIPTION

FIG. 1 is a fragmentary front elevational of a preferred embodiment of the wrench socket assembly of the present invention, with the sockets and smooth-shanked studs shown in central vertical section;

FIG. 2 is an end elevational view of the assembly of FIG. 1, with the end socket and stud shown in central vertical section and the socket canted relative to the stud for accommodating angling of a handle in applying and removing a socket to and from a stud;

FIG. 3 is a fragmentary plan view of the assembly of FIG. 1, showing a preferred socket having the size and shape of the socket's work opening imprinted on its drive end; and FIG. 4 is a fragmentary vertical cross-sectional view of the assembly, showing a socket seated on an alternate form of the improved stud of the present invention in which the stud's shank below the ball is uniformly threaded.

DETAILED DESCRIPTION

Referring now in detail to the drawings in which like reference characters designate like parts, the improved wrench socket assembly of the present invention is particularly designed to hold a set or sequence of wrench sockets with their drive ends up or exposed for selective engagement by a wrench handle, by a set of studs removably mounted in selected arrangement on a support and each including a bolt and an elastomeric ball molded about a head of the bolt and compressibly and swivelly fittable in a work opening of a corresponding socket.

Designated as 1, the illustrated socket wrench assembly is comprised of a support, which, if separate from a tool box, preferably is a three-legged stand 2 adapted for placing or positioning without rocking on an uneven surface and suitably made of bent or stamped sheet or cast metal, the stand having a flat, usually horizontal, shelf or web 3 perforated by a selectively arranged set, series or plurality of laterally spaced drillings or openings 4. Conveniently uniform in diameter, the drillings 4 interchangeably receive or seat a set or series of socket-mounting studs 5.

Each of the studs 5 includes a bolt 6 having an integral head 7 of square, hex or other suitable configuration and a rubber or like elastomeric ball or spherical outer head 8 molded to the bolt about its integral or inner head. While, for a set of sockets 9 having work or nut-and-bolt openings 10 of progressively reduced cross-sectional area, the companion set of studs 5 will have elastomeric balls 8 of correspondingly reduced diameter, and the ball of each stud 5 will be of a size or diameter to fit, seat or be received compressibly in the work opening 10 of one or a single socket of the set. When so seated, the ball 8 firmly grips and holds the socket 9, while still enabling the socket to swivel relative to the ball to accommodate angling of a head of a wrench handle 9*a* relative to the support 2 in applying and removing a socket to and from a stud 5.

Two modes of attachment or mounting of the studs 5 to the support 2 are illustrated in the drawings, one in FIGS. 1 and 2 and the other in FIG. 4. As illustrated in FIGS. 1 and 2, the objective of both modes is to so position the ball 8 in the work opening 10 of the related socket 9, that the ball in operative or socket-holding position, is spaced vertically from the upper and lower limits of the work opening and consequently allows the socket to swivel on the ball. To so position a ball 8 of a stud 5 depends for a given socket on the height of the ball above the shelf or other supporting surface 3. In the form of FIGS. 1 and 2, this is achieved with a stud 5 having a shank or stem 11, by providing the shank below the ball with an intermediate smooth portion 12 terminating downwardly or away from the ball in a shoulder or abutment 13 and therebelow in a coaxial threaded lower or distal end portion 14 of a relatively reduced diameter to fit in one of the drillings 4. In this form, the shoulder or abutment 13 supports the stud 5 by engaging the shelf 3 either directly or through an interposed washer and a locknut 15 on the threaded portion 14 below the shelf fastens the stud to the shelf. The smooth portion 12 of the shank 11 in cross-section may be round or, for ready gripping by a wrench, have a square or other or other flatted part 16.

Since in the form of FIGS. 1 and 2, the length of a stud's shank 11 between the shelf 3 and ball 8 is substantially fixed, such studs are best adapted to hold a set of sockets 9 having work openings 10 of uniform depth. However, sockets are available that have work openings 10 of the same size and shape but different depth. Studs 5 of the form shown in FIG. 4 in which the shank 11 in whole or its intermediate and distal end portions 12 and 14 below the ball 8 are uniformly threaded, are readily adjustable in height or length, by use of nuts both above and below the supporting shelf 3, to accommodate variations in the depth of work openings 10 of the same size and shape.

While mounting, seating or storing of sockets 9 with their drive ends 17 up or exposed, simplifies the task of attaching and detaching a socket to and from a wrench handle, it does pose a problem in selecting a socket of the required size and shape, since the work openings 10 are hidden so long as the sockets are held by the studs 5. To simplify selection of a socket as well as its attachment to a wrench handle, the sockets 9 of this assembly have indicia 18 of the size and illustrated hex or other multi-sided shape of their work openings 10 imprinted, inset or indented and preferably anodized in their drive ends 17 about the usually square drive openings 19 into which the drive element (not shown) of the wrench handle is inserted. If desired, indicia of the size and shape of the work openings 10 of the sockets 9 can also be applied to a side of the supporting stand 2. Also, the supporting shelf on which the studs are mounted can be either separate from or a shelf of a mechanic's tool box.

From the above detailed description it will be apparent that there has been provided an improved wrench socket assembly in which sockets are releasably held in a desired sequence or arrangement with their drive openings exposed for selective engagement by a wrench handle, are so held by elastomeric balls molded on studs and compressibly and swivelly received in their work openings, the studs are removably mounted on a work surface, and the size and shape of each socket is indicated by an anodized or other inset, indentation or imprint in its drive end.

It should be understood that the described and disclosed embodiment is merely exemplary of the invention and that modifications are to be included that do not depart from the spirit of the invention and the scope of the appended claims.

Having now described my invention, I claim:

1. A wrench socket assembly comprising stud means removably mounted on a supporting surface for holding wrench socket means with drive ends exposed for engagement by a wrench handle, said stud means having molded thereon an elastomeric spherical ball selectively and compressibly fittable in a work opening of and firmly gripping one of said socket means, wherein the socket means are a plurality of sockets having work openings of different cross-sectional area, and each socket is swivelable relative to the elastomeric ball fitting its work opening for accommodating relative angling of a wrench handle in applying and removing a socket to and from one of said stud means.

2. A wrench socket assembly according to claim 1, wherein indicia of the size and shape of the work opening of each socket is imprinted in the drive end thereof.

3. A wrench socket assembly according to claim 2 in which the indicia is anodized about a drive opening in the drive end of the socket.

4. A wrench socket assembly comprising stud means removably mounted on a supporting surface for holding wrench socket means with drive ends exposed for engagement by a wrench handle, said stud means each having molded thereon an elastomeric spherical ball selectively and compressibly fittable in a work opening of and firmly gripping one of said stud means, wherein the stud means are a plurality of studs each including a bolt having a head about which the elastomeric ball thereof is molded, the studs having shanks terminating in distal end portions interchangeably seatable in uniform laterally spaced openings in the supporting surface.

5. A wrench socket assembly according to claim 4, wherein the shanks of the studs are each of a length above the distal end portion thereof to position the ball thereof intermediate ends of a work opening of a socket in which said ball is compressibly fittable when the work end of said socket is seated on the supporting surface.

6. A wrench socket assembly according to claim 5, wherein the shank of each stud above the distal end portion thereof is shouldered for support on the supporting surface and the stud is bolted in place by a locknut on said distal end portion below said supporting surface.

7. A wrench socket assembly according to claim 5, wherein to accommodate sockets having work openings of like cross-sectional area but different depth, shanks of selected of said studs are uniformly threaded over their lengths below the balls for adjustment of their effective lengths and bolting in place by nuts applied thereto above and below the supporting surface.

8. A wrench socket assembly comprising stud means removably mounted on a supporting surface for holding wrench socket means with drive ends exposed for engagement by a wrench handle, said stud means each having molded thereon an elastomeric spherical ball selectively and compressibly fittable in a work opening of and firmly gripping one of said socket means, wherein the supporting surface is a substantially horizontally disposed web of a three-legged portable stand whereon a set of sockets is readily held in selected arrangement and moved to work sites.

* * * * *